US007046210B1

(12) United States Patent
Brooker et al.

(10) Patent No.: US 7,046,210 B1
(45) Date of Patent: May 16, 2006

(54) PRECISION ADJUSTMENT ANTENNA MOUNT AND ALIGNMENT METHOD

(75) Inventors: Ralph Brooker, Alexandria, VA (US); Tommy Tulloch, Aberdour (GB); Steve Buchan, Perth (GB); Richard Dempster, Kircaldy (GB)

(73) Assignee: Andrew Corporation, Westchester, IL (US)

( * ) Notice: Subject to any disclaimer, the term of this patent is extended or adjusted under 35 U.S.C. 154(b) by 0 days.

(21) Appl. No.: 10/907,352

(22) Filed: Mar. 30, 2005

(51) Int. Cl.
*H01Q 3/02* (2006.01)

(52) U.S. Cl. ..... 343/880; 343/882

(58) Field of Classification Search ..... 343/878, 343/879, 880, 881, 882, 890, 892, 761, 760, 343/763; H01Q 3/20, 3/02
See application file for complete search history.

(56) References Cited

U.S. PATENT DOCUMENTS

| | | | | |
|---|---|---|---|---|
| 4,251,819 | A | 2/1981 | Vickland | |
| 4,404,565 | A | 9/1983 | Gurney et al. | |
| 4,652,890 | A | 3/1987 | Crean | |
| 4,692,771 | A | 9/1987 | Rothbarth et al. | |
| 4,819,002 | A * | 4/1989 | Reboullet | 343/765 |
| 4,819,006 | A | 4/1989 | Whitesides et al. | |
| 4,819,007 | A | 4/1989 | Tezcan | |
| 4,924,239 | A | 5/1990 | Ceklovsky | |
| 4,980,697 | A | 12/1990 | Eklund | |
| 4,994,816 | A | 2/1991 | Kondo | |
| 5,000,408 | A | 3/1991 | Bourgeois et al. | |
| 5,402,140 | A | 3/1995 | Rodeffer | |
| 5,657,031 | A | 8/1997 | Anderson et al. | |
| 5,835,068 | A * | 11/1998 | Paul et al. | 343/757 |
| 5,929,817 | A | 7/1999 | Clark | |
| 5,933,123 | A | 8/1999 | Kaul | |
| 5,982,333 | A | 11/1999 | Stillinger et al. | |
| 5,999,139 | A * | 12/1999 | Benjamin et al. | 343/765 |
| 6,208,317 | B1 | 3/2001 | Taylor et al. | |
| 6,225,962 | B1 | 5/2001 | Blanchard et al. | |
| 6,342,870 | B1 | 1/2002 | Mehrkens et al. | |
| 6,404,400 | B1 | 6/2002 | Tulloch | |
| 6,445,361 | B1 | 9/2002 | Liu et al. | |
| 6,462,718 | B1 | 10/2002 | Ehrenberg et al. | |
| 6,469,679 | B1 * | 10/2002 | Yoshida et al. | 343/892 |
| 6,507,325 | B1 | 1/2003 | Matz et al. | |
| 6,657,598 | B1 | 12/2003 | Tulloch | |
| 2004/0169114 | A1 | 9/2004 | Dierkes | |
| 2004/0222931 | A1 | 11/2004 | Matz et al. | |

* cited by examiner

*Primary Examiner*—Hoanganh Le
(74) *Attorney, Agent, or Firm*—Babcock IP, LLC

(57) ABSTRACT

An antenna mount with a primary mount having a connecting surface(s) for an azimuth plate. The azimuth plate rotationally coupled to the connecting surface via an az-pivot fastener and rigidly connectable to the connecting surface via a pair of az-lockdown fasteners passing through az-lockdown slots in the azimuth plate. A pair of connection point(s) of the primary mount and the azimuth plate, respectively, movable towards and away from each other as an azimuth bolt coupling the connection points is threaded in or out of a threaded surface at one of the pair of connection points. The azimuth bolt carrying an az-bias spring compressed between the connection points biasing the connection points apart. Movement of the connection points towards and away from each other pivoting the azimuth plate with respect to the primary mount about the az-pivot fastener. Further pivot surfaces may also be added, providing an additional adjustment axis.

23 Claims, 7 Drawing Sheets

PRECISION ADJUSTMENT ANTENNA MOUNT AND ALIGNMENT METHOD

BACKGROUND

For optimal performance, a directional antenna such as a reflector antenna must be closely aligned with a target signal source. Alignment of a reflector antenna is typically performed via an adjustable antenna mount that, with respect to a fixed mounting point, is adjustable in azimuth and elevation to orient the antenna towards the target signal source.

Antenna mount coarse adjustment is often cost effectively incorporated into an antenna mount via a movable connection coupled to a fixed point, for example via one or more slot(s) and or a pivot point and a slot along which the pivot angle of the movable connection may be fixed by tightening one or more fasteners. Fine adjustments are difficult to make in these arrangements because the targeting resolution along the slot(s) is very low due to the free movement of the movable connection until the bolt(s) are tightened. Further, the weight of the antenna acts as a cantilever on the associated fasteners, distorting the selected alignment by biasing the fasteners towards an open rather than lock down fastener position. After the desired alignment has been achieved, for example by monitoring signal peaking, tightening these fasteners to the lock down position causes the alignment to shift back, causing a pointing error that cannot be readily compensated by the installer. Furthermore, when the fastener(s) are tightened, imperfect bearing and contact points between the adjusting surfaces can cause additional pointing error as the mechanism distorts.

Where multiple feeds are applied to a single reflector to simultaneously receive closely spaced beams from different satellites, precision alignment is critical to achieve acceptable signal performance with respect to each of the satellites. High resolution adjustment capability may also be used for a single feed reflector and or terrestrial applications where precision alignment is desired.

The adjustable antenna mount must support the entire antenna mass and also withstand any expected environmental factors such as wind shear and or ice loading. However, adjustable antenna mounts that are both sufficiently strong and easily adjustable with precision significantly increase the overall cost of the resulting antenna.

The conventional method for aiming an antenna is to adjust the azimuth and elevation mechanism until the maximum signal strength is received from the desired signal source, for example a satellite. In the presence of noise, random fluctuations in propagation loss, and other error, this method is not very accurate, because the gain of the antenna, as a function of pointing angle, varies only a small amount when it is close to boresight.

A better method is the so-called "bracketing" or "dither" technique, in which the amount of signal reduction is equalized for an equal positive and negative shift in pointing angle. This method generally requires an accurate calibrated scale of pointing angle and the corresponding mechanical accuracy of the mechanism. It also requires substantially more operator skill than the simple peaking method.

Neither of these prior methods allows for a final offset to account for factors such as circular polarization squint or satellite position offset.

The increasing competition for reflector antennas and associated mounting assemblies adapted for both industrial and high volume consumer applications such as data, VSAT, satellite tv and or internet communications has focused attention on cost reductions resulting from increased materials, manufacturing and service efficiencies. Further, reductions in required assembly operations and the total number of discrete parts are desired.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with the general and detailed descriptions of the invention appearing herein, serve to explain the principles of the invention.

DETAILED DESCRIPTION

Figure 1:
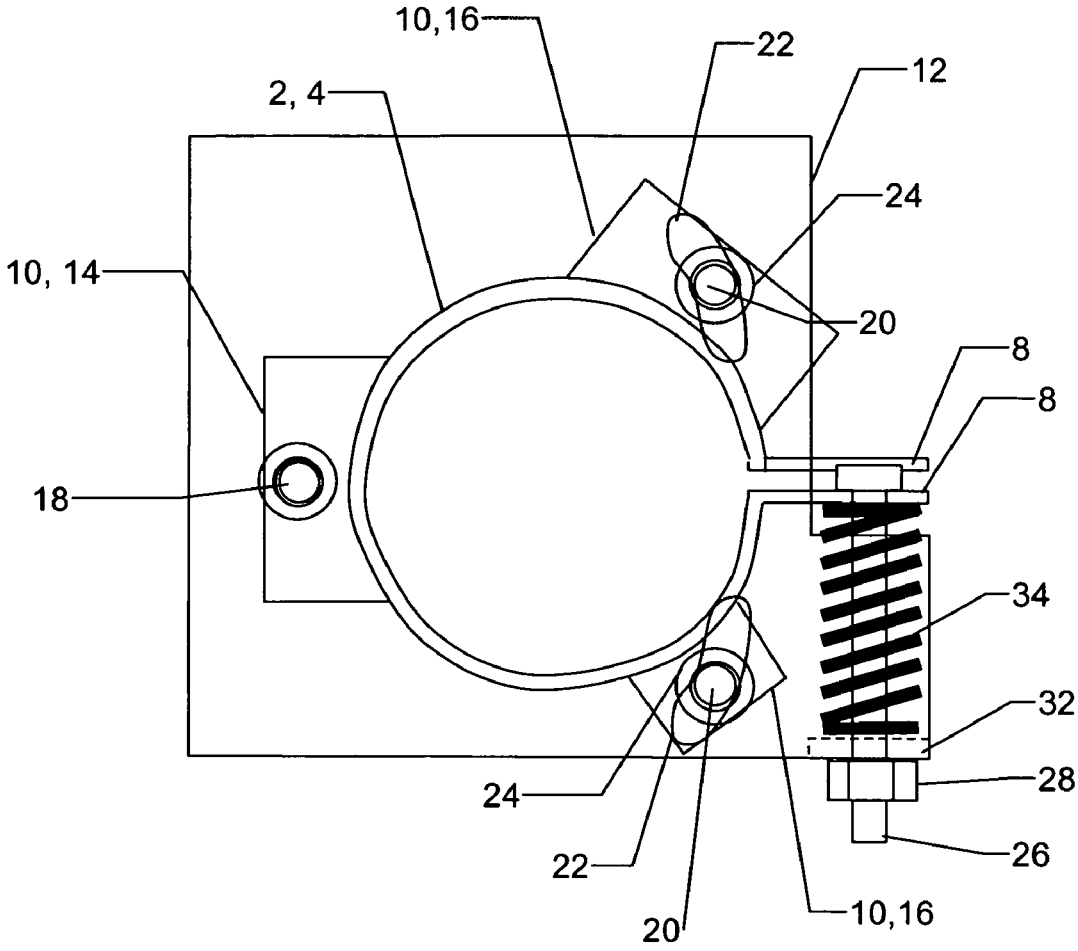
FIG. 1 is a schematic top view of an exemplary embodiment of the invention with the azimuth plate transparent for clarity.
Figure 2:
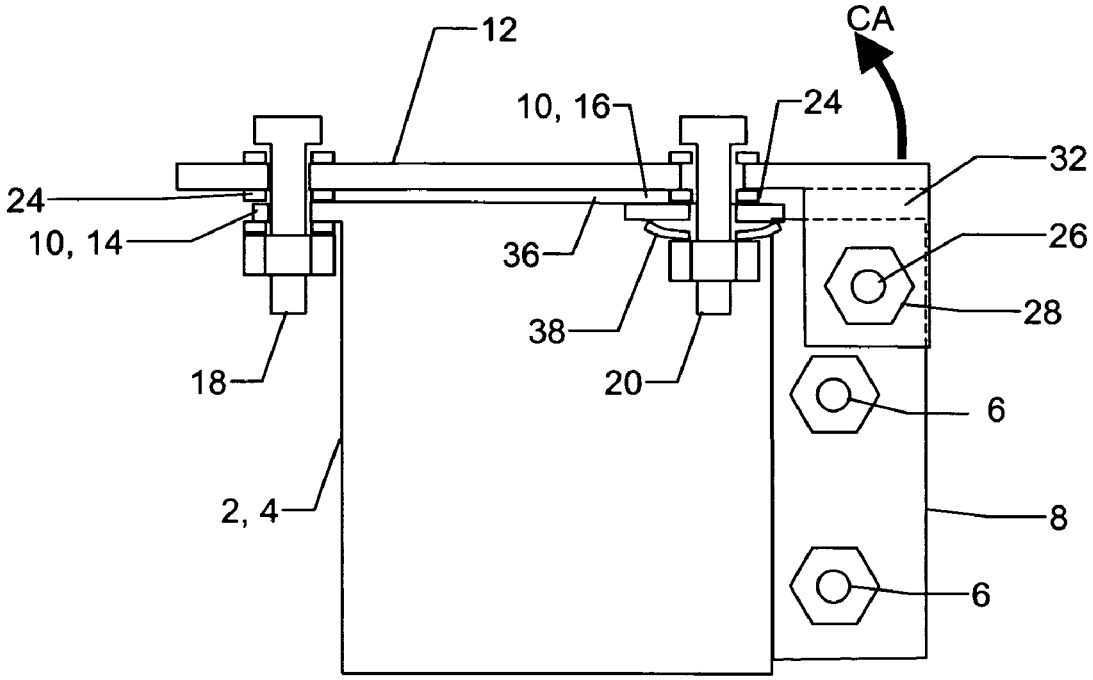
FIG. 2 is a schematic side partial section view of FIG. 1.

A first embodiment of a fine adjusting antenna mount is shown in FIGS. 1 and 2. A primary mount 2 is adapted to secure the antenna mount upon a desired mounting point. In the present embodiment, the primary mount 2 is a pipe clamp 4 adapted to mount upon the end of a cylindrical mounting pole or mast (not shown) via clamp fastener(s) 6 such as a nut and bolt through clamp fastening tab(s) 8. Alternatively, the primary mount 2 may be any rigid connection to a desired mounting point. Coarse azimuth adjustment is effected by rotation of the primary mount 2 about the mounting point prior to final tightening of the, for example, clamp fastener(s) 6. The top of the primary mount 2 is formed with a connecting surface(s) 10 for an azimuth plate 12, such as integral front and rear mounting tabs 14, 16.

Fine azimuth adjustments are obtained by pivoting the azimuth plate 12 about an az-pivot fastener 18 that couples the azimuth plate 12 to the front tab 14. The az-pivot fastener 18 may be a removable and or fastening force adjustable nut and bolt or a permanently connected fastener such as a rivet. Az-lockdown fastener(s) 20 coupling the two rear tab(s) 16 to the azimuth plate 12 move through az-lockdown slots 22 in the azimuth plate 12 the extents of which define the range of available fine azimuth adjustment. An equivalent alternative structure being the location of the az-lockdown slot(s) 22 in the connecting surface(s) 10 of the primary mount 2, in addition to or rather than in the azimuth plate 12.

Where four or more contact points (including nominal surfaces) are present, imperfect tolerances between the points may cause gaps that close upon tightening of az-lockdown fastener(s) 20, introducing alignment errors. Washer (s) 24, for example slip washers may be placed around each of the az-pivot and the two az-lock-down fastener(s) 18, 20 to separate the azimuth plate 12 from the primary mount 2 thus enforcing contact there between at exactly three load contact points. Because the az-pivot and lock-down fastener (s) 18, 20 are concentric with the three washer(s) 24, no distortion is introduced into the structures when these fastener(s) are tightened. In order to improve the performance of the azimuth motion, the washer(s) 24 could be made of, or coated with, a low-friction material such as nylon or PTFE.

Fine azimuth adjustment may be controlled by an azimuth bolt 26, threaded rod or the like and a threaded surface 28 such as a nut operable by threading to adjust a distance between connection point(s) 30 on the primary mount 2 and the azimuth plate 12, thereby introducing a pivot motion about the az-pivot fastener 18. Alternatively, the threaded surface 28 may be integrated with one of the connection point(s) 30. The connection point(s) 30 may be, for example, one or both of the clamp fastening tab(s) 8, and a downward projecting adjustment tab 32 of the azimuth plate 12. An az-bias spring 34 biased between the connection point(s) 30 urges a reverse azimuth pivot motion as the azimuth bolt 26 is loosened and also constantly biases the threading between the azimuth bolt 26 and the threaded surface 28 to absorb any threading slop or backlash that may be present. When fine adjustment is complete, the az-lock-down fastener(s) 20 and az-pivot fastener 18, if applicable, are tightened, thus forming a rigid high-strength connection between the azimuth plate 12 and the primary mount 2 at the selected azimuth angle.

The antenna (not shown) may be attached via the azimuth plate 12, commonly resulting in a combined center of gravity that is located forward of the az-pivot fastener 18. Therefore, as shown in FIG. 2, a cantilever effect in the direction indicated by arrow CA acting on a fulcrum at the az-pivot fastener 18 will urge a gap 36 to open between the azimuth plate 12 and the primary mount 2 when the az-lock-down fastener(s) 20 are loosened for azimuth adjustment, thus causing an elevation shift. To counteract the cantilever effect, CA spring(s) 38, such as a Belleville washer, may be positioned carried by the az-lockdown fastener(s) 20 to bias the connecting surface(s) 10 against the azimuth plate 12. The CA spring 38 parameters would be adjusted such that when the az-lockdown fastener(s) 20 are loosened, the CA spring 38 force exceeds the cantilever torque, but not by so much that the static friction prevents the azimuth mechanism from being moved by the az-bias spring 34.

Figure 3:
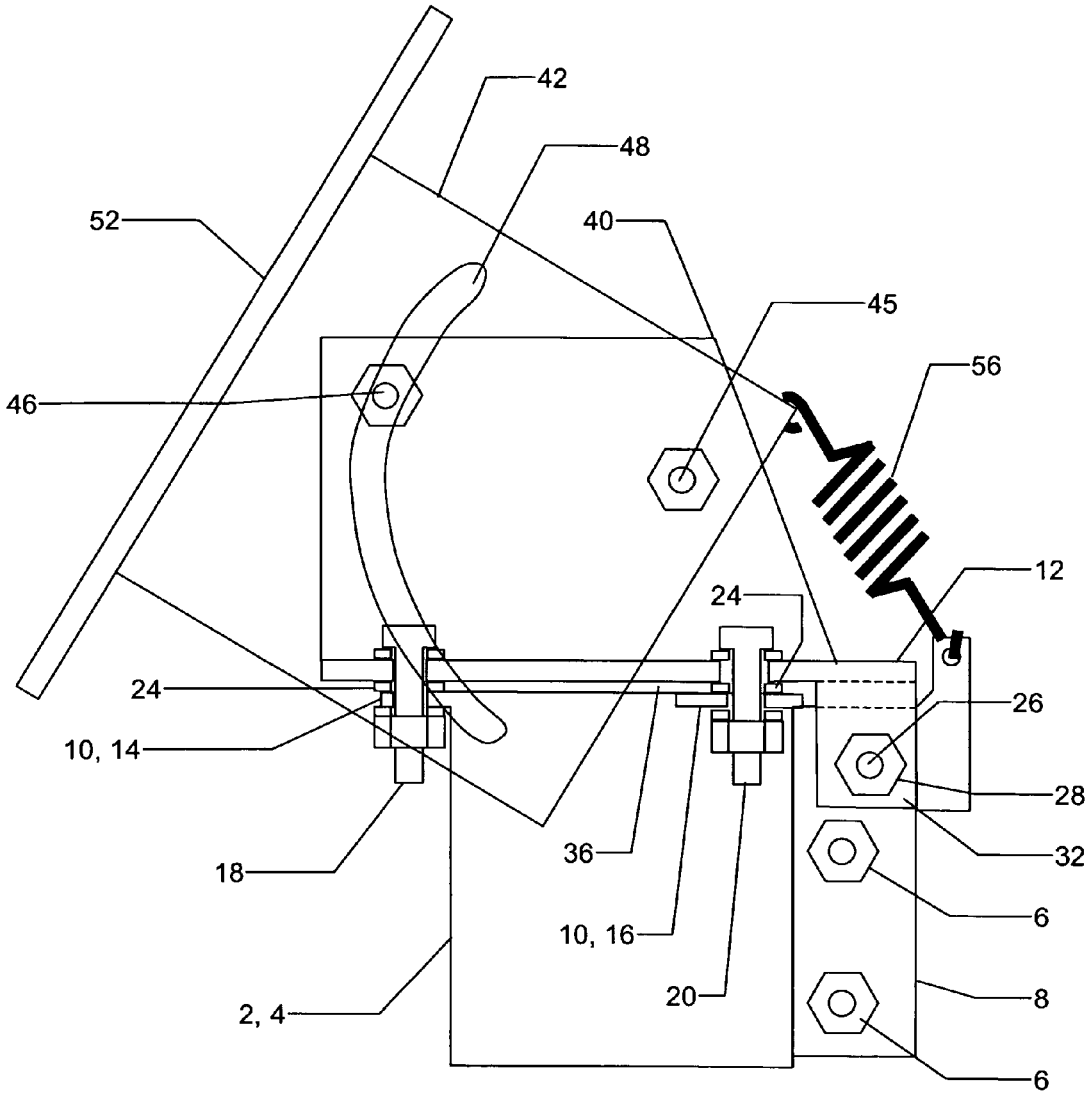
FIG. 3 is a schematic side partial section view, including elevation adjustment features, parallel ends of the elevation bracket transparent for clarity.

The fine azimuth adjusting antenna mount of FIGS. 1 and 2 may be enhanced to include elevation adjustment, as shown for example in FIG. 3. End tab(s) 40 are added to opposing sides of the azimuth plate 12, angled upward normal to the azimuth plate 12. A generally U-shaped elevation bracket 42 with parallel end(s) 44 rotates around an elevation pivot formed by el-pivot fastener(s) 45 that couple the parallel end(s) 44 of the elevation bracket 42 to the end tab(s) 40.

A selected elevation angle of the elevation bracket 42 about the elevation pivot may be locked by dual el-lock-down fastener(s) 46 coupling the elevation bracket 42 to the end tab(s) 40 through corresponding arc slot(s) 48 formed in the elevation bracket 42 having a radius of curvature generally about the elevation pivot.

The antenna may be directly coupled to the elevation bracket 42 via, for example, mounting tab(s) 50 or to an antenna mounting surface 52 that then is coupled to the mounting tab(s) 50. The antenna mounting surface 52 is useful where a further rotational tilt adjustment mechanism is desired between the antenna and the antenna mount. To reduce the number of discrete components, the antenna mounting surface 52 may be permanently coupled to the elevation bracket 42 via rivets, spot welding or the like.

Also demonstrated in FIG. 3 is an alternative mechanism of compensating for cantilever load. A counterbalance spring 54 provides tension force between a central area 56 of the elevation bracket 42 and an extension 58 of the primary mount 2. An advantage of this embodiment is that by determining the load geometry of the antenna over the range of movement of the elevation mechanism and selection of corresponding spring parameters, the torque imparted by the counterbalance spring 54 may be configured to change corresponding to the cantilever torque as the elevation bracket 42 moves through its range of motion, allowing the fine azimuth mechanism operation to be optimized over a wide range of elevation settings and also compensating for a significant portion of the antenna weight that must be supported prior to tightening of the el-lockdown fastener(s) 46 at the desired elevation angle. Because the azimuth fine adjustment range is small, aligning the antenna mount at either end of the fine azimuth adjustment range does not significantly change the required parameters of the counterbalance spring 54.

In a further variation of the antenna mount, fine elevation adjustment functionality may be added to the general configuration of FIG. 2 by the addition of a threaded elevation bolt 58 coupled between the central area 56 of the elevation bracket 42 and at least one of the el-lockdown fastener(s) 46, as shown for example in FIGS. 4–8. As the elevation bracket 42 may be adapted to move though a wide angular range of movement, the threaded elevation bolt 58 connection to the elevation bracket 42 is arranged to allow a corresponding angular movement. As best viewed in FIG. 7, an aperture 60 in the elevation bracket may be formed with rounded edge(s) adapted to seat a ball 62 that the elevation bolt 58 passes through. The ball 62 is then retained in the aperture 60 between the elevation bracket 42 and a retaining plate 64 coupled to the elevation bracket 42. An exploded view of the elevation bolt assembly appears in FIG. 8. An el-thimble 66 with graduated indicia 68 may be added, keyed to the elevation bolt 58, between the ball 62 and the head of the elevation bolt 58 to provide high resolution operator feedback on the threading progress of the elevation bolt 58 to pivot the elevation bracket 42 to a desired angle about the elevation pivot. Angular changes occurring at the el-lock-down fastener 46 that the elevation bolt 58 threads into are compensated for by rotation of the el-lockdown fastener 46 within the associated end tab 40 el-lockdown hole.

Figure 4:
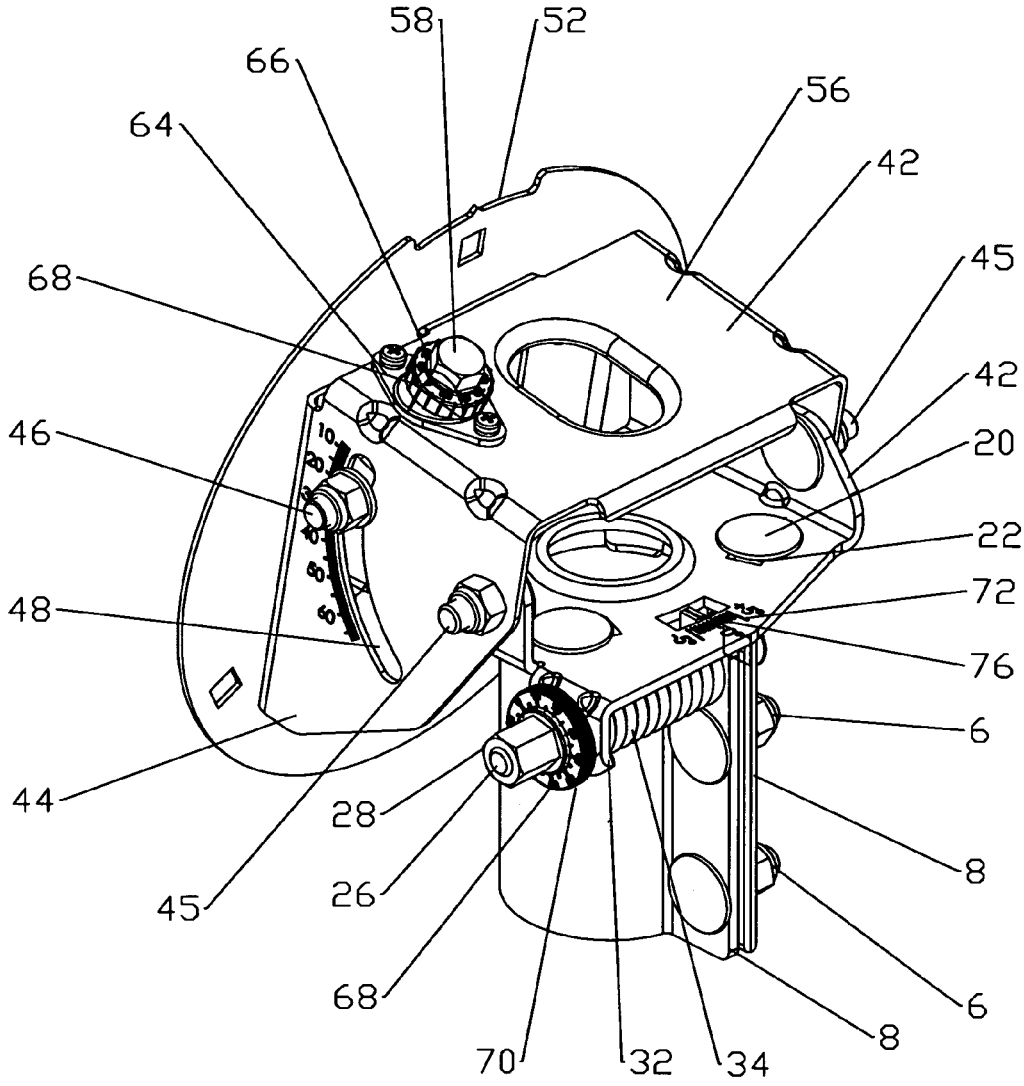
FIG. 4 is an isometric angled side view of an embodiment including fine elevation adjustment.
Figure 5:
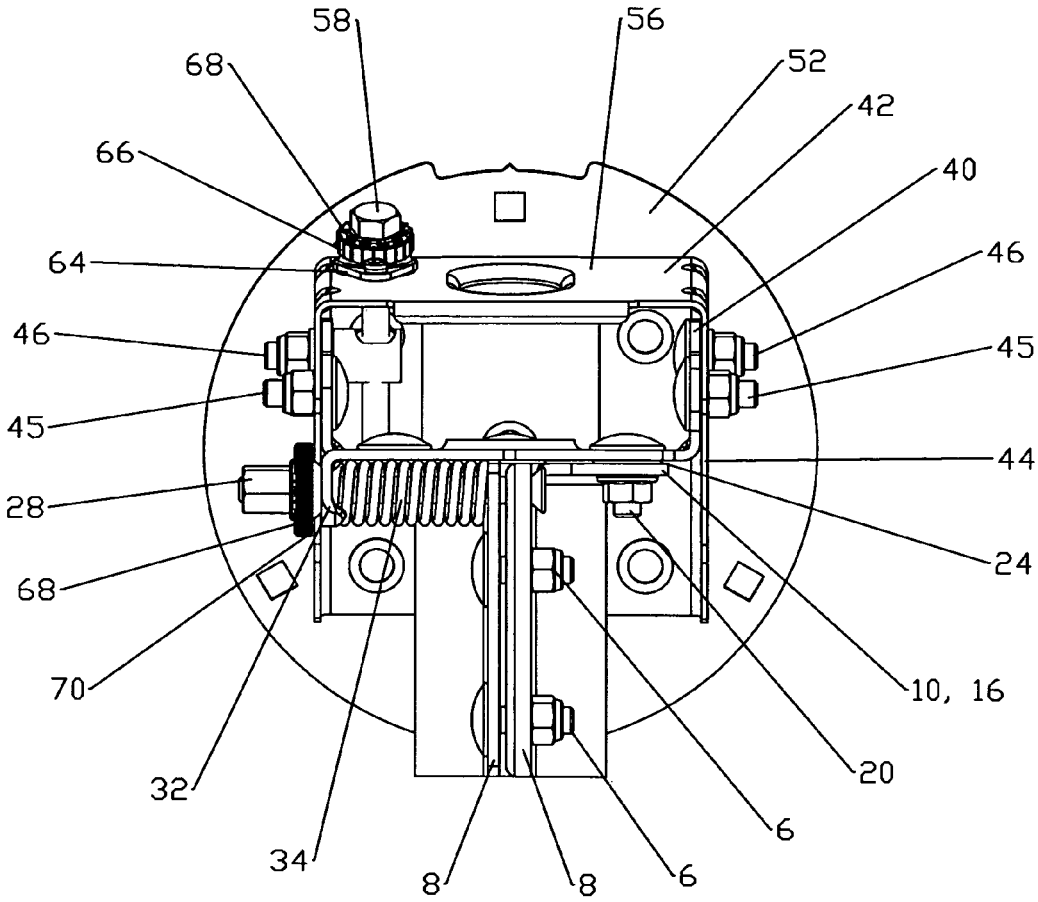
FIG. 5 is a back view of FIG. 4.
Figure 6:
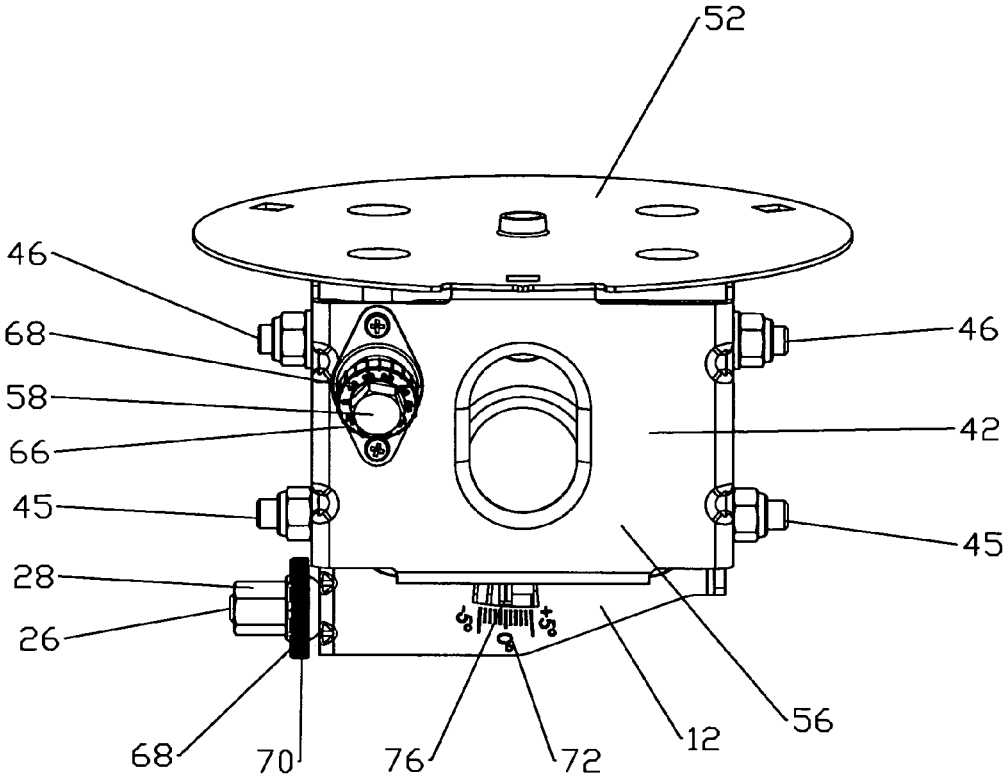
FIG. 6 is a top view of FIG. 4.
Figure 7:
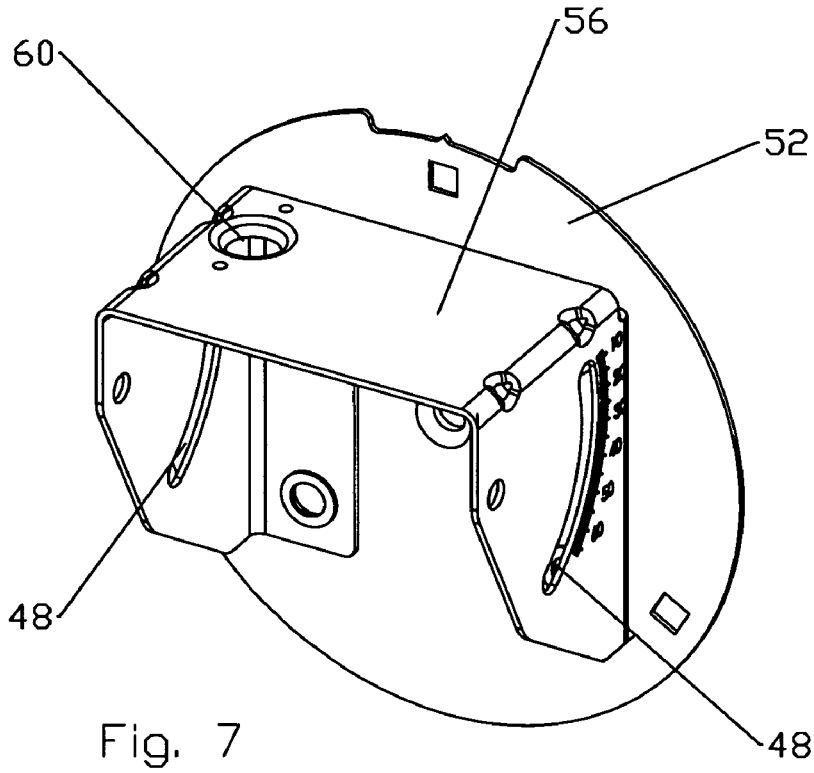
FIG. 7 is an isometric side view of the elevation bracket and antenna mounting surface of FIG. 4.
Figure 8:
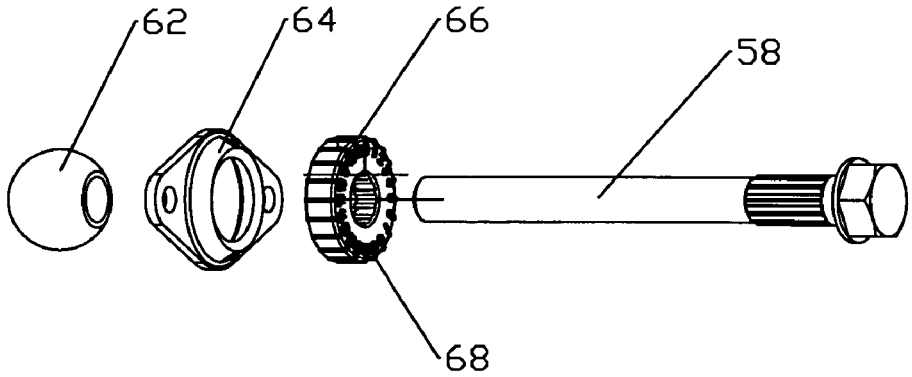
FIG. 8 is an exploded isometric side view of the elevation bolt assembly of FIG. 4.

Also shown in FIGS. 4 and 5 are additional operator feedback indicia related to the azimuth fine adjustment that may also be incorporated in the antenna mount. An az-thimble 70 with graduated indicia 68 of, for example, 0–100 graduations may be similarly added to the azimouth bolt 26 to enable repeated fine tuning of known increments less than a full rotation of the azimuth bolt 26. A graduated scale 72 showing, for example, plus or minus degree increments of azimuth plate 12 pivot relative to the primary mount 2 may also be easily added by adding a scale slot 74 to the azimuth plate 12 through which a stationary mark 76 of the primary mount 2 may be viewed.

In use, the az-thimble 70 and el-thimble 66 provide an operator reference gauge of, for example, 0 to 100 increments, marked around each thimble perimeter. Movable fiducial mark(s) proximate each of the az-thimble 70 and the el-thimble 66 may be applied to zero each scale before starting a measured rotation of the respective bolt (or vice versa). The operator can thus measure the rotation of the fastener as 100 units per turn. The antenna may also be supplied with a reference table, for example attached to the antenna, or on a data/configuration card supplied with the antenna.

An alignment procedure using the high resolution provided by the az-thimble and el-thimble is as follows:

1. Bring the signal to a certain level below peak, e.g. about 3–6 dB, note the signal meter or tone pitch, and zero the signal meter gauge or otherwise record the specific signal level.

2. Turn one of the az-thimble 70 and the el-thimble 66, or their associated bolt head or threaded surface 28, to bring the signal past its peak, then to the exact same signal level, meter reading and or tone pitch. The number of whole and fractional turns as indicated, for example, by the graduated indicia 68 on the az-thimble 70 and or el-thimble 66.

3. Calculate a target number by either (a) dividing the number of whole and fractional turns from the previous step by two, or (b) using a supplied look-up table. In the latter case, the lookup table can include pre-calculated offsets to correct for cross polarization, squint, actual versus nominal spacecraft position, etc. The target number representing whole and fractional turns scaled to correspond with graduated indicia 68.

3. Turn the nut back to unwind backlash, if any, then turn it forward to the starting point of step 2. Continue to turn forward by the number of whole turns (hundreds) in the target number, and stop at the corresponding target scale reading.

If required, repeat for the other of the az-thimble 70 and the el-thimble 66 not previously selected in step 2.

One skilled in the art will appreciate that the main components of the invention may be cost effectively fabricated by metal stamping. Alternatively, die casting and or injection molding may be applied. The specific exemplary embodiment of the invention described herein in detail is demonstrated with respect to a vertical pole mounting but may alternatively be readily adapted to a particular desired mounting surface and or mounting surface orientation. While the present invention has been demonstrated with mating u-brackets, equivalent elevation pivoting structures may be formed by mating angle or T-brackets having sufficient materials strength to withstand the expected weight and environmental stresses upon the antenna mount.

The present invention provides an antenna mount with precision alignment capability having significantly reduced complexity and manufacturing precision requirements, resulting in a significant reduction in overall cost. Also, the time required for installation and configuration of a reflector antenna incorporating an antenna mount according to the invention is similarly reduced using the invention's antenna alignment method enabled by high resolution of alignment adjustments enabled by the azimuth and or elevation bolts, aided by the graduated indicia 68 of the az-thimble 70 and el-thimble 66.

Table of Parts

| | |
|---|---|
| 2 | primary mount |
| 4 | pipe clamp |
| 6 | clamp fastener |
| 8 | clamp fastening tab |
| 10 | connecting surface |
| 12 | azimuth plate |
| 14 | front tab |
| 16 | rear tab |
| 18 | az-pivot fastener |

-continued

Table of Parts

| | |
|---|---|
| 20 | az-lockdown fastener |
| 22 | az-lockdown slot |
| 24 | washer |
| 26 | azimuth bolt |
| 28 | threaded surface |
| 30 | connection point |
| 32 | adjustment tab |
| 34 | az-bias spring |
| 36 | gap |
| 38 | CA spring |
| 40 | end tab |
| 42 | elevation bracket |
| 44 | parallel end |
| 46 | el-lockdown fastener |
| 48 | arc slot |
| 50 | mounting tab |
| 52 | antenna mounting surface |
| 54 | counterbalance spring |
| 56 | central area |
| 58 | elevation bolt |
| 60 | aperture |
| 62 | ball |
| 64 | retaining plate |
| 66 | el-thimble |
| 68 | graduated indicia |
| 70 | az-thimble |
| 72 | graduated scale |
| 74 | scale slot |
| 76 | mark |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. An antenna mount, comprising:

a primary mount having a connecting surface(s) for an azimuth plate;

the azimuth plate rotationally coupled to the connecting surface via an az-pivot fastener and rigidly connectable to the connecting surface via a pair of az-lockdown fasteners passing through az-lockdown slots in the azimuth plate;

a pair of connection point(s) of the primary mount and the azimuth plate, respectively, movable towards and away from each other as an azimuth bolt coupling the connection points is threaded in or out of a threaded surface at one of the pair of connection points;

the azimuth bolt carrying an az-bias spring compressed between the connection points that biases the connection points apart;

movement of the connection points towards and away from each other pivoting the azimuth plate with respect to the primary mount about the az-pivot fastener.

2. The antenna mount of claim 1, wherein each of the az-pivot fastener and the two az-lockdown fastener(s) have a washer thereon positioned between the connecting surface and the azimuth plate.

3. The antenna mount of claim 1, wherein the primary mount is a pipe clamp which clamps around a cylindrical mount point.

4. The antenna of claim 1, wherein a CA spring is carried by one or both of the az-lockdown fasteners, the CA spring arranged to bias the connecting surface against the azimuth plate.

5. The antenna mount of claim 1, wherein the connection point(s) are an adjustment tab of the azimuth plate, normal to the connection surface(s) and a fastening tab of the primary mount, normal to the connection surface(s).

6. The antenna mount of claim 1, further including an az-thimble coupled to the azimuth bolt; the az-thimble having graduation indicia for indicating a degree of rotation of the elevation bolt less than a full turn.

7. The antenna mount of claim 1, further including a scale slot formed in the azimuth plate and a graduation indicia proximate the scale slot;

a mark on the primary mount visible through the scale slot.

8. The antenna mount of claim 1, further including end tabs projecting from opposing sides of the azimuth plate, normal to the azimuth plate;

a generally U-shaped elevation bracket coupled at parallel ends of the U-shaped bracket to the end tabs by a pair of el-pivot fastener(s);

a pair of el-lockdown fastener(s) coupled through arc slots formed in the parallel ends to the end tabs; the arc slots having a radius of curvature generally about the el-pivot fastener(s); the elevation bracket rotatable about the el-pivot fastener(s) to a desired elevation angle with respect to the azimuth plate.

9. The antenna mount of claim 8, further including a counterbalance spring coupled between the primary mount and the elevation bracket;

the counterbalance spring in tension, urging the elevation bracket into an upward angle;

a spring tension characteristic of the counterbalance spring selected to counterbalance a cantilever load of an antenna coupled to the elevation bracket.

10. The antenna mount of claim 8, further including an antenna mounting surface coupled to a first side of the elevation bracket parallel end(s).

11. The antenna mount of claim 8, further including an elevation bolt threadably coupled between a central area of the elevation bracket and one of the el-lockdown fastener(s);

threading of the elevation bolt operating to pivot the elevation bracket about the el-pivot fastener(s) to the desired elevation angle with respect to the azimuth plate.

12. The antenna mount of claim 11, wherein the elevation bolt passes through a ball that is retained against an aperture in the central area of the elevation bracket by a retaining plate.

13. The antenna mount of claim 11, further including an el-thimble coupled to the elevation bolt; the el-thimble having graduation indicia for indicating a degree of rotation of the elevation bolt less than a full turn.

14. A method of aligning an antenna, comprising the steps of 1. aligning an antenna such that a target signal is below but proximate a signal level peak, and recording a reference signal level;
2. rotating an azimuth bolt operative to pivot an azimuth plate of an antenna mount of the antenna with respect to a primary mount to bring the signal to and past the signal level peak, again to the reference signal level, recording a number and fraction of rotations required to reach the reference signal level;
3. calculating a back rotation number by one of (a) dividing the number and fraction of rotations by two to obtain a back rotation number, and (b) applying the number and fraction of rotations to a look-up table; the lookup table designating the back rotation number; and
3. rotating the azimuth bolt in an opposite direction an amount equal to the back rotation number.

15. The method of claim 14, further including the step of repeating the steps with respect to rotation of an elevation bolt operative to pivot an elevation bracket with respect to the azimuth plate, instead of rotating the azimuth bolt.

16. The method of claim 14, wherein the look-up table incorporates pre-calculated offsets to correct for one or more of circular polarization squint, and actual versus nominal satellite position.

17. The method of claim 14, wherein backlash is removed before starting to rotate the back rotation number in the opposite direction.

18. An antenna mount, comprising:

a primary mount having a connecting surface(s) for an azimuth plate;

the azimuth plate rotationally coupled to the connecting surface via an az-pivot fastener and rigidly connectable to the connecting surface via a pair of az-lockdown fasteners passing through az-lockdown slots in the azimuth plate;

an adjustment tab of the azimuth plate, normal to the connection surface(s);

a fastening tab of the primary mount, normal to the connection surface(s);

the adjustment tab and the fastening tab, movable towards and away from each other as an azimuth bolt coupling the adjustment tab and the fastening tab is threaded in or out of a threaded surface at one of the adjustment tab and the fastening tab;

the azimuth bolt carrying an az-bias spring compressed between the adjustment tab and the fastening tab that biases the adjustment tab and the fastening tab apart;

movement of the adjustment tab and the fastening tab towards and away from each other pivoting the azimuth plate with respect to the primary mount about the az-pivot fastener;

a pair of end tabs projecting from opposing sides of the azimuth plate, normal to the azimuth plate;

a generally U-shaped elevation bracket coupled at parallel ends of the U-shaped bracket to the end tabs by a pair of el-pivot fastener(s);

a pair of el-lockdown fastener(s) coupled through arc slots formed in the parallel ends to the end tabs; the arc slots having a radius of curvature generally about the el-pivot fastener(s); the elevation bracket rotatable about the el-pivot fastener(s) to a desired elevation angle with respect to the azimuth plate.

19. The antenna mount of claim 18, wherein each of the az-pivot fastener and the two az-lockdown fastener(s) have a washer thereon positioned between the connecting surface and the azimuth plate.

20. The antenna mount of claim 18, further including an elevation bolt threadably coupled between a central area of the elevation bracket and one of the el-lockdown fastener(s);

threading of the elevation bolt operating to pivot the elevation bracket about the el-pivot fastener(s) to the desired elevation angle with respect to the azimuth plate.

21. An antenna mount, comprising:

a primary mount having a connecting surface(s) for an azimuth plate;

the azimuth plate rotationally coupled to the connecting surface via an az-pivot fastener and rigidly connectable to the connecting surface via a pair of az-lockdown fasteners;

the azimuth plate and the connecting surface spaced apart, the az-pivot fastener and the pair of az-lockdown fasteners forming a total of three load contact points between the azimuth plate and the connecting surface.

22. The antenna mount of claim 21, further including end tabs projecting from opposing sides of the azimuth plate, normal to the azimuth plate;

a generally U-shaped elevation bracket coupled at parallel ends of the U-shaped bracket to the end tabs by a pair of el-pivot fastener(s);

a pair of el-lockdown fastener(s) coupled through arc slots formed in the parallel ends to the end tabs; the arc slots having a radius of curvature generally about the el-pivot fastener(s); the elevation bracket rotatable about the el-pivot fastener(s) to a desired elevation angle with respect to the azimuth plate.

23. The antenna mount of claim 22, further including a counterbalance spring coupled between the primary mount and the elevation bracket;

the counterbalance spring in tension, urging the elevation bracket into an upward angle;

a spring tension characteristic of the counterbalance spring selected to counterbalance a cantilever load of an antenna coupled to the elevation bracket.

* * * * *